United States Patent [19]

Sung et al.

[11] Patent Number: 4,948,386

[45] Date of Patent: Aug. 14, 1990

[54] MIDDLE DISTILLATE CONTAINING STORAGE STABILITY ADDITIVE

[75] Inventors: Rodney L. Sung, Fishkill; Benjamin J. Kaufman, Hopewell Junction, both of N.Y.; Karol J. Thomas, Norwalk, Conn.

[73] Assignee: Texaco Inc., White Plains, N.Y.

[21] Appl. No.: 267,947

[22] Filed: Nov. 7, 1988

[51] Int. Cl.[5] ..... C10L 1/18; C10L 1/22

[52] U.S. Cl. ..... 44/57; 44/63; 44/71

[58] Field of Search ..... 44/63, 57

[56] References Cited

U.S. PATENT DOCUMENTS

| | | | |
|---|---|---|---|
| 4,648,886 | 3/1987 | Buckley, III et al. | 44/63 |
| 4,780,111 | 10/1988 | Dorer et al. | 44/63 |
| 4,798,612 | 1/1989 | Plavac et al. | 44/63 |

*Primary Examiner*—William R. Dixon, Jr.
*Assistant Examiner*—E. McAvoy
*Attorney, Agent, or Firm*—Robert A. Kulason; James J. O'Loughlin; Carl G. Seutter

[57] ABSTRACT

Additives formed by reaction of polyacids such as 1,3,6-hexane tricarboxylic acid and polyisobutenyl succinimide of a polyamine are effective in improving the storage stability of middle distillate fuels.

18 Claims, No Drawings

MIDDLE DISTILLATE CONTAINING STORAGE STABILITY ADDITIVE

FIELD OF THE INVENTION

This invention relates to middle distillate oils. More particularly it relates to additives which provide improved storage stability for middle distillate oils.

BACKGROUND OF THE INVENTION

As is well known to those skilled in the art, middle distillate fuels typified by diesel oil, Avjet fuel, fuel oils, kerosene, etc. may be stored for extended periods of time under unfavorable conditions which are conducive to formation of solid deposits. These deposits, which are produced during storage at room temperature in the presence of air, accumulate on strainers, filters, screens, etc. with which the oil comes into contact and ultimately plug the openings with resultant problems in operation.

The propensity of a system to form a deposit may be determined by ASTM Test D-2274 which provides indications of oxidative deterioration or stability of a fuel. In the Potential Deposit (PDT) Test, comparable indications are obtained under more severe conditions. In this test, a test specimen of oil is subject to contact with air at elevated temperature; and after 2 hours, the turbidity of the specimen is determined on a scale of 1–4. A rating of 1 or 2 is satisfactory and a rating of 3 or 4 is unsatisfactory.

Background of the instant invention may be obtained from numerous patents including U.S. Pat. No. 4,548,724; 4,533,361, etc.

It is an object of this invention to provide an improved middle distillate fuel composition characterized by improved performance as determined by the Potential Deposit Test. Other objects will be apparent to those skilled in the art.

STATEMENT OF THE INVENTION

In accordance with certain of its aspects, this invention is directed to a middle distillate hydrocarbon composition characterized by its stability in the presence of air comprising a major portion of a middle distillate hydrocarbon oil and a minor effective stabilizing portion, as an additive, of the product prepared by reaction of (i) a hydrocarbyl-substituted mono- or bis-succinimide bearing polyamine

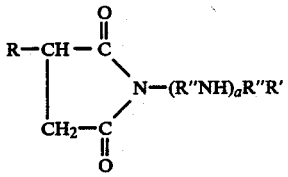

wherein

R is an alkenyl group containing about 8–400 carbon atoms;

R″ is a divalent hydrocarbon group selected from the group consisting of alkylene, alkarylene, aralkylene, cycloalkylene, arylene, alkenylene, and alkynlene;

R′ is —$NH_2$, —NHR‴ or a hydrocarbyl-substituted succinimide group

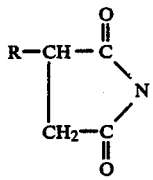

R‴ is a hydrocarbon group selected from the group consisting of alkyl, aralkyl, alkaryl, alkaryl, alkenyl, alkynyl, cycloalkyl, and aryl;

a is an integer 1–8 with (ii) an organic polycarboxlic acid R* $(COOH)_x$ wherein x is an integer 3–6; and R* is a hydrocarbon group derived by removing a–1 hydrogen atoms from an alkyl, alkaryl, aralkyl, cycloalkyl, aryl, alkenyl, or alkynyl hydrocarbon group thereby forming product; and recovering said product.

DESCRIPTION OF THE INVENTION

The middle distillate fuels which may be employed in practice of the process of this invention may typically include those having an ibp of 300° F.–450° F., say 369° F.; a 50% bp of 400° F.–550° F.; say 496° F.; a 90% bp of 475° F.–625° F., say 586° F.; an EP of 500° F.–650° F., say 627° F.; and an API Gravity of 25–45, say 37.3. These fuels may commonly be labelled as kerosene, fuel oil, diesel oil, No. 1-D, No. 2-D etc. One preferred middle distillate may be a diesel oil having the following properties:

TABLE

| Property | Value |
|---|---|
| API Gravity D-1298 | 37.3 |
| Kin. Vis. cSt °40° C. D-445 | 2.27 |
| Cetane D-163 | 49.6 |
| Distillation D-86 (°F.) | |
| IBP | 369 |
| 50% | 496 |
| 90% | 586 |
| EP | 627 |

Another preferred charge may be a middle distillate fuel oil having the following typical characteristics:

TABLE

| Property | Value |
|---|---|
| API Gravity D-1298 | 43.0 |
| Kin. Vis. cSt °40° C. D-445 | 1.57 |
| Cetane D-163 | 47 |
| Distillation D-86 (°F.) | |
| IBP | 344 |
| 50% | 429 |
| 90% | 490 |
| EP | 524 |

Another preferred charge may be No. 2 fuel oil having the following properties:

TABLE

| Property | Value |
|---|---|
| API Gravity D-1298 | 35.7 |
| Kin. Vis. cSt °40° C. D-445 | 2.40 |
| Cetane D-163 | 44.7 |
| Distillation D-86 (°F.) | |
| IBP | 388 |
| 50% | 510 |
| 90% | 596 |

TABLE-continued

| Property | Value |
|---|---|
| EP | 653 |

Another preferred charge may be a kerosene having the following properties:

TABLE

| Property | Value |
|---|---|
| API Gravity D-1298 | 43.0 |
| Kin. Vis. cSt °40° C. D-445 | 1.57 |
| Cetane D-163 | 47 |
| Distillation D-86 (°F.) | |
| IBP | 344 |
| 50% | 429 |
| 90% | 490 |
| EP | 524 |

Another preferred charge may be a diesel fuel having the following properties:

TABLE

| Property | Value |
|---|---|
| API Gravity D-1298 | 32.8 |
| Kin. Vis. cSt °40° C. D-445 | 2.2 |
| Cetane D-163 | 42.2 |
| Distillation D-86 (°F.) | |
| IBP | 356 |
| 50% | 495 |
| 90% | 610 |
| EP | 640 |

It is a particular feature of this invention that it is possible to improve the properties of a diesel fuel cut which is prepared by high temperature and pressure hydrogenation (as typified by that obtained as product from processes identified as "H-Oil" processes etc).

TABLE

| Diesel Fuel Cut From H-Oil | |
|---|---|
| Flash Point, °F.CM | 280 |
| Cloud Point, °F. | +5 |
| Pour Point, °F. | 0 |
| Kin. Vis. cS@ 40° F. | 4.3 |
| Cetane | 50.6 |
| FIA Analysis | |
| % Aromatics | 35.5 |
| % Olefins | 12.5 |
| % Saturates | 52.0 |
| S % | 0.41 |
| Con. Cu strip 3 hrs 122° F. | 1A |
| API Gravity | 31.4 |
| ASTM Distillation, °F. | |
| IBP | 540 |
| 10% | 556 |
| 30% | 561 |
| 50% | 566 |
| 70% | 572 |
| 90% | 582 |
| EP | 593 |

The charge materials which may be employed to form the additive used in practice of the process of this invention include as a first reactant a hydrocarbyl-substituted mono- or bis-succinimide bearing a polyamine.

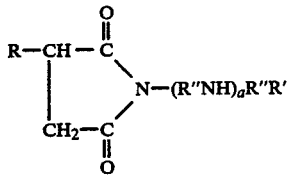

wherein

R is an alkenyl group containing about 8–400 carbon atoms;

R″ is a divalent hydrocarbon group selected from group consisting of alkylene, alkarylene, aralkylene, cycloalkylene, arylene, alkenylene, and alkynylene;

R′ is $—NH_2$, —NHR‴ or a hydrocarbyl-substituted succinimide group

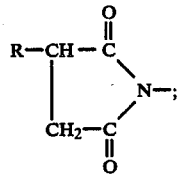

R‴ is a hydrocarbon group selected from the group consisting of alkyl, alkaryl, aralkyl, alkenyl, alkynyl, cycloalkyl, and aryl; and a is an integer 1–8.

In the above formula R is an alkenyl group containing about 8–400, preferably 70–170, say about 100 carbon atoms. Preferably R is a polyolefin group of molecular weight of 900–2000, preferably 1000–1300, say 1290, containing residual unsaturation formed by polymerizing an olefin. Typical olefins which may be polymerized include ethylene, propylene, butylene, amylene, etc. In the preferred embodiment, R is a polyisobutylene group ($C_4H_8$) of molecular weight of 900–2000.

In the above formula, R″ may be a hydrocarbon group selected from the group consisting of alkylene, cycloalkylene, arylene, alkarylene, and alkynylene including such radicals when inertly substituted. When R″ is alkylene, it may typically be methylene, ethylene, n-propylene, isopropylene, n-butylene, sec-butylene, amylene, octylene, decylene, octadecylene, etc. When R″ is aralkylene, it may typically be, phenylethylene, etc. When R″ is cycloalkylene, it may typically be cyclohexylene, cycloheptylene, cyclooctylene, 2-methylcycloheptylene, 3-butylcyclohexylene, 3-methylcyclohexylene, etc. When R″ is arylene, it may typically be phenylene, naphthylene, etc. When R″ is alkarylene, it may typically be tolylene, xylylene, etc.

When R″ is alkenylene, it may typically be vinylene, allylene, 1-butenylene, etc. When R″ is alkynylene, it may typically be ethynylene, propynylene, butynylene, etc. R″ may be inertly substituted i.e. it may bear non-reactive substituent such as alkyl, aryl, cycloalkyl, ether, etc. Typically inertly substituted R″ groups may include 2-ethoxyethylene, carboethoxymethylene, 4-methyl cyclohexylene, p-ethylphenylene, 3-ethyl-5-methylphenylene, etc. The preferred R″ groups may be lower alkylene i.e. $C_1$–$C_{10}$ alkylene, groups included eg methylene, ethylene, n-propylene i-propylene, butylene, amylene, hexylene, octylene, decylene, etc. R″ may preferably be ethylene $—CH_2CH_2—$.

In the above compound, R‴ may be a hydrocarbon group selected from the group consisting of alkyl, aralkyl, cycloalkyl, aryl, alkaryl, alkenyl, and alkynyl including such radicals when inertly substituted. When R''' is alkyl, it may typically be methyl, ethyl, n-propyl, iso-propyl, n-butyl, i-butyl, sec-butyl, amyl, octyl, decyl, octadecyl, etc. When R''' is aralkyl, it may typically be benzyl, beta-phenylethyl, etc. When R''' is cycloalkyl, it may typically be cyclohexyl, cycloheptyl, cyclooctyl, 2-methylcyclo-heptyl, 3-butylcyclohexyl, 3-methylcyclohexyl, etc. When R''' is aryl, it may typically be phenyl, naphthyl, etc. When R''' is alkaryl, it may typically be tolyl, xylyl, etc. When R''' is alkenyl, it may typically be vinyl, allyl, 1-butenyl, etc. When R''' is alkynyl, it may typically be ethynyl, propynyl, butynyl, etc. R''' may be inertly substituted i.e. it may bear a non-reactive substituent such as alkyl, aryl, cycloalkyl, ether, etc. Typically inertly substituted R groups may include 2-ethoxyethyl, carboethoxymethyl, 4-methyl cyclohexyl, 2-ethyl-5-methylphenyl, etc. The preferred R''' groups may be lower alkyl, i.e. $C_1$–$C_{10}$ alkyl, groups including eg methyl, ethyl, n-propyl, i-propyl, butyls, amyls, hexyls, octyls, decyls, etc. R''' may preferably be n-propyl.

R' may be —$NH_2$, —NHR''' or a hydrocarbyl substituted group.

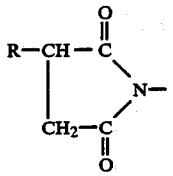

When R' is the noted succinimide group, the first reactant may for example include those of the form

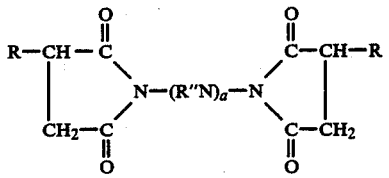

These compounds may be available or readily prepared by the reactions:

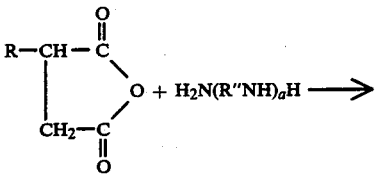

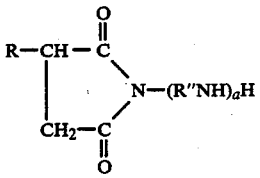

-continued

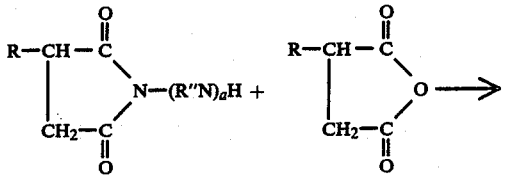

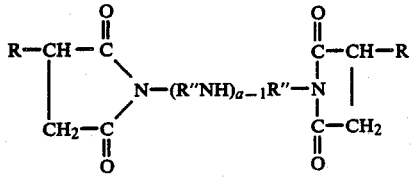

Preferred hydrocarbyl-substituted mono- or bis-succinimides which may be employed include:

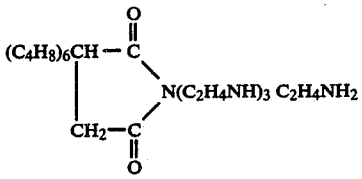

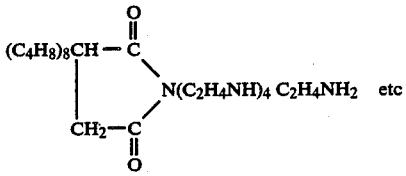

The second reactant may be an organic polycarboxylic acid $R^*(COOH)_x$ wherein x is an integer 3–6, preferably 3. It will be apparent that the polyvalent R* group may be most readily nomenclated with reference to the alkyl group containing the same number of carbon atoms which it most closely resembles but subject to the qualification that (instead of the typical single open valence bond of the alkyl group) it contains x open valence bonds. For example for convenience, an illustrative group may be designated herein as polyvalent n-hexyl (n-hexyl has the standard configuration $CH_3CH_2CH_2CH_2CH_2CH_2$-) and in fact this designation will include eg the following groups inter alia:

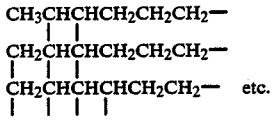

In accordance with this nomenclature, R* may be a hydrocarbon group selected from the group consisting of alkyl, aralkyl, cycloalkyl, aryl, and alkaryl, including such radicals when inertly substituted. When R* is alkyl, it may typically be methyl, ethyl, n-propyl, iso-propyl, n-butyl, i-butyl, sec-butyl, amyl, octyl, decyl, octadecyl, etc. When R* is aralkyl, it may typically be benzyl, phenylethyl, etc. When R* is cycloalkyl, it may typically be cyclohexyl, cycloheptyl, cyclooctyl, 2-methylcyclo-heptyl, 3-butylcyclohexyl, 3-methylcyclohexyl, etc. When R* is aryl, it may typically be phenyl, naphthyl, etc. When R* may be be inertly substituted i.e. it may bear a non-reactive substituent such as alkyl, aryl, cycloalkyl, ether, etc. Typically inertly substituted R* groups may include 2-ethoxyethyl, carboethoxymethyl, 4-methyl cyclohexyl, 3-ethyl-5-methylphenyl, etc. The preferred R* groups may be alkyl groups having 5–10 carbon atoms, groups including eg amyl, hexyl, octyl, decyl, etc. R* may preferably be hexyl.

Specific typical polyvalent R* groups may include:

TABLE

| | |
|---|---|
| $CH_2CH_2CH_2CHCH_2CH_2$ | (i) |
| $CH_2CHCH_2CHCH_2CH_2$ | (ii) |
| $CH_3CHCHCH_2$ | (iii) |
| $C_6H_5CHCHCH_2$ | (iv) |
| 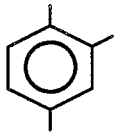 | (v) |
| 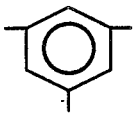 | (vi) |
| 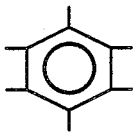 | (vii) |

Illustrative second reactant compounds may include the following:

TABLE

A. $CH_2CH_2CH_2CHCH_2CH_2COOH$
$COOH \quad COOH$

B. $CH_2 \quad CHCH_2CHCH_2CH_2COOH$
$COOH COOH \quad COOH$

C. $CH_3CH \quad CHCH_2COOH$
$COOH COOH$

D. 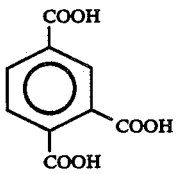 trimellitic Acid

TABLE-continued

E. $HO-CH-COOH$
$CH-COOH$
$CH_2-COOH$ isocitric acid

F. $CH-COOH$
$C-COOH$
$CH_2-COOH$ aconitic acid

G. $O=C-COOH$
$CH-COOH$
$CH_2-COOH$ oxalo succinic acid

H. 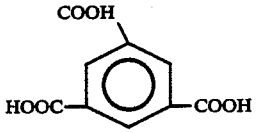 trimesic acid

I. 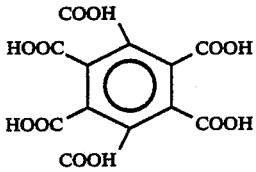 benzene hexacarboxylic acid

J. 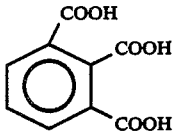 hemi-mellitic acid

K. 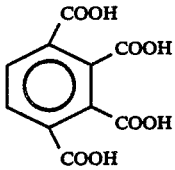 prehnitic acid

L. $C-COOH$
$HO-C-COOH$
$C-COOH$ citric acid

Reaction may be carried out by adding substantially equal equivalents of the reactants to the reaction mixture. It will be apparent to those skilled in the art that equal equivalent will depend upon (i) the number of nitrogen atoms in the succinimide (ii) the number of carboxyl groups in the second reactant, and (iii) the number of such groups which it is desired to react. It is possible for example to react less than all of the carboxyl groups with the amino groups (and to thus prepare products having free carboxyl groups). In the preferred embodiment however, each of the acid groups will be reacted with an amine group and converted to the corresponding amide groups. Mixtures of acids or of amines may be employed.

In view of the nature of the reactants and the plurality of the amine groups and carboxyl groups present, the relative proportions of the reactants may be controlled so that the resultant product contains the least amount of free acid as measured by total acid number. This is equivalent to saying that the reaction is preferably carried out by using the acid in amount of 20 mole %–90 mole % of the equivalent amount required to react with the amine groups, and by controlling the reaction conditions and time.

By way of illustration, if the charge first reactant N-polyalkyleneamine succinimide contains the grouping

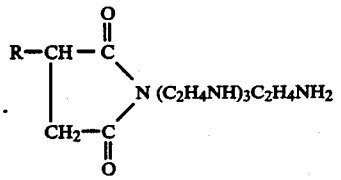

and the second reactant is 1,3,6-trihexanoic acid, then if it be desired to produce the preferred product, equal equivalents of reactants may be one mole of each. If one desires to produce e.g. less preferred reaction products containing free carboxyl groups, then greater quantities of the acid will be employed.

It is a particular feature of the process of this invention in its preferred embodiment utilizing 1,3,6-trihexane tricarboxylic acid (also called 1,3,6-trihexanoic acid) that this inexpensive, by-product acid may be used; and since the acid is tribasic, the actual quantity of acid employed is thus typically one-third of the weight of a monobasic acid when preparing a product of comparable molecular weight. Note U.S. Pat. No. 4,548,724 to Texaco as assignee of Thomas J. Karol, Rodney L. Sung, and Benjamin J. Kaufman directing to lubricating oils.

It is also to be noted that improved product characteristics are attained when reaction is carried out so that at least about 30 atom % of the reactive nitrogen atoms in the succinimide chain have been reacted to form an amide with the carboxyl groups of the acid or mixtures of acids. Preferably 50–100 atom %, more preferably 85–100 atom %, say 100 atom % of these nitrogen groups will be reacted; and the final product may thus contain minimal basic nitrogen groups.

In the preferred embodiment of the process of this invention, the succinimide first reactant may be prepared in situ by the reaction of alkenyl succinic acid anhydride and amine $H_2N(R''N)_aR''NH_2$. This preferred mode of operation is to add the anhydride to the reaction mixture as a solution in, or substantially simultaneous with, inert diluent-solvent. The inert diluent-solvent may include liquid hydrocarbons such as oil stocks which are compatible with the ultimate composition in which the additive is to be blended. A preferred diluent-solvent may be a diesel oil cut present in amount of 50–100 parts, say 100 parts per 100 parts of anhydride.

The reaction mixture may then be preferably warmed to 50° C.–100° C., say 60° C. and placed in an inert atmosphere which is typically nitrogen.

The amine is preferably added with agitation. The reaction mixture is then heated to 110° C.–120° C. and maintained at this temperature for 60–120 minutes, say about 60 minutes. A small amount of anti-foamant is added, typically about 0.05 w%, based upon the anhydride, of silicone oil. Then the polycarboxylic acid is added; and the reaction mixture is heated to 140° C.–180° C., say 160° C. and maintained at that temperature for 4–10 hours, say 8 hours. The product is then filtered hot at the temperature of reaction; and the so prepared product in diluent solvent may be utilized without further treatment.

During the course of the reaction, the following may occur:

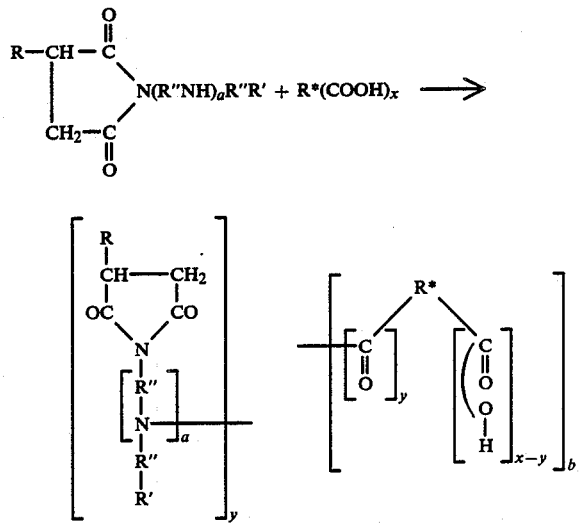

wherein
x is 3–6;
y is 1–3;
a is 1–8;
b is 0.01–3;

In a preferred embodiment wherein 1,3,6-hexane tricarboxylic acid is reacted with the reaction product of a polyisobutylene (MW or 1290) succinic acid anhydride and tetraethylene pentamine, the product may be

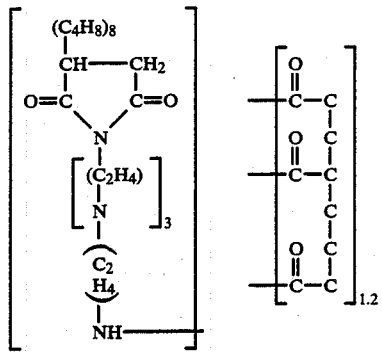

It will be apparent to those skilled in the art that because of the fact that each reactant contains a plurality of reacting groups, the resulting product may not be a simple compound but will undoubtedly include compounds containing an intricate network of products formed as a result of eg different amine group of one molecule of succinimide bonding with carboxyl group on different molecules of acid and different carboxyl groups of one molecule of acid bonding with an amine group (on different molecules of succinimide).

For those reasons the product will be characterized by the mole ratio of reactants or more commonly by its gross characteristics including molecular weight $M_n$, TBN, TAN, and by its ability to serve as eg a stabilizer in middle distillate hydrocarbon oil.

The products of this invention may be added to middle distillate hydrocarbon oil compositions to impart thereto improvements in stability. Typical middle distillate hydrocarbon oils to which the additives of this invention may be added include kerosene, diesel oil, fuel oil, etc. Typically the additive may be present in minor effective storage stabilizing amount of 0.0005–0.05 w%, preferably 0.005–0.0167 w%, say 0.0083 w% which corresponds to 1.5–150 PTB, preferably 15–50 PTB, say 25 PTB. PTB is an abbreviation of pounds per thousand barrels.

Addition of the additive of this invention to a middle distillate hydrocarbon oil may be facilitated by use of a concentrate containing 25–95 w%, preferably 50–70 w%, of additive in a diluent-solvent which may in the preferred embodiment be the same as the middle distillate hydrocarbon oil in which the additive is to be formulated.

It is a feature of the process of this invention that the novel middle distillate hydrocarbon oils containing a minor effective amount of the additive of this invention may be particularly characterized by their improved stability as measured by ASTM D-2274.

It is a feature of the additives of this invention that they are cost-effective stabilizers which are characterized by a low level of residual acid. The preferred 1,3,5-trihexanoic acid (1,3,6-hexane tricarboxylic acid) is a very inexpensive acid produced as a waste stream; and this permits production of desired product at low cost. It may be desirable to utilize the compositions of this invention (as extenders) in combination with similar composition prepared from more expensive starting materials (eg glycolic acid).

DESCRIPTION OF SPECIFIC EMBODIMENTS

Practice of the process of this invention will be apparent to those skilled in the art from the following wherein, as elsewhere in this description, all parts are parts by weight. Unfilled valence bonds may be filled with hydrogen or with inert substituents.

EXAMPLE I

In this example, 31.6g(0.167 moles) of tetraethylenepentamine and 384 grams of 100 E Pale Stock HF are charged and nitrogen blanketed. There is then added 400g(0.185 moles) of polyisobutenyl ($\overline{M}w$ 1290) succinic acid anhydride having a Sap No. of 51.9. Stock HF diluent oil. The reaction mixture is then heated to 100° C.–120° C. and maintained in this temperature range for on hour.

There is then added 0.1 ml of silicone oil anti-foamant and 44g (0.212 moles) of 1,3,6-hexanetricarboxylic acid. The reaction mixture is heated to 160° C., removing water as it is formed, and maintained at that temperature for 8 hours, The product is filtered hot.

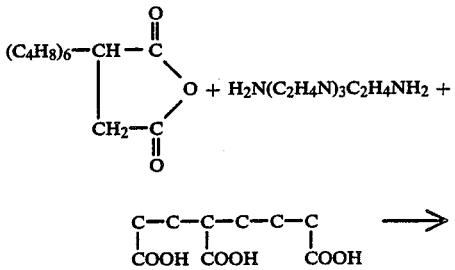

-continued

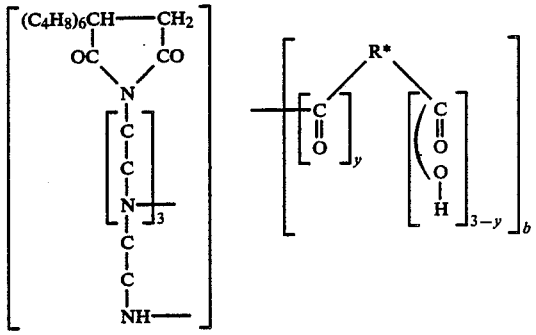

wherein y is 2.5 and b is ca 1.2

EXAMPLE II

| Materials | Grams | Moles |
|---|---|---|
| polyisobutenyl ($\overline{M}_n$ 1290) | 200 | 0.093 |
| succinic acid anhydride | | |
| tetraethylenepentamine | 11.4 | 0.060 |
| 100 E Pale Stock HF | 187.4 | — |
| 1,3,6-hexane-tricarboxylic acid | 12.5 | 0.060 |
| silcone oil antifoamant | 0.05 ml | |

The procedure of Example I is followed using the above charge materials in the quantities noted—except that the reaction mixture is heated to 60° C. immediately after the anhydride and the Pale Stock are charged.

The product of the reaction is:

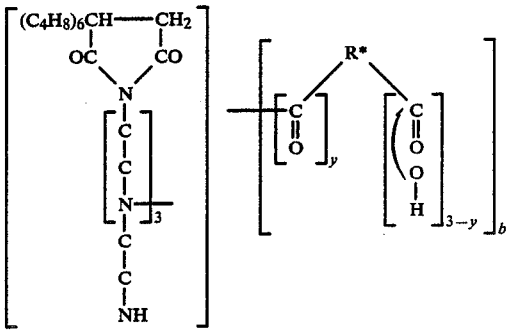

wherein y is ca 2.5 and b is ca 1.25

The reaction mixture may also contain about 50 w% of

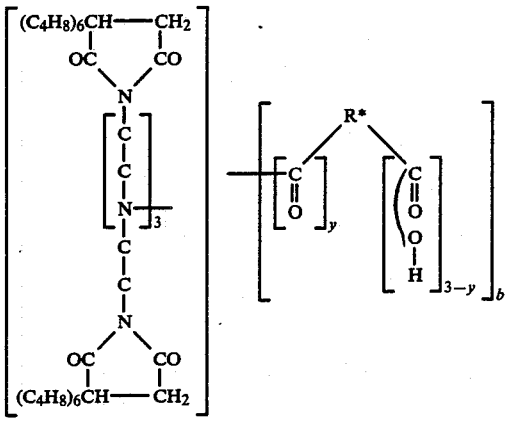

wherein
y is ca 2.5 and
b is ca 0.85

EXAMPLE III

| Materials | Grams | Moles |
|---|---|---|
| polyisobutenyl ($\overline{M}_n$ 1290) succinic acid anhydride | 200 | 0.093 |
| commercial pentaethylenehexamine | 15.6 | 0.060 |
| 100 E Pale Stock HF | 191.6 | — |
| 1,3,6-hexane-tricarboxylic acid | 14.9 | 0.072 |
| silcone oil antifoamant 0.05 ml | | |

The procedure of Example II is followed.
The reaction mixture contains:

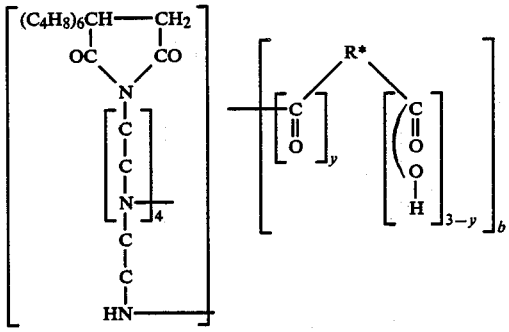

wherein
y is ca 2.5 and
b is ca 1.2

The reaction mixture also contains 50 w% of the analogue containing two succinimide rings wherein y is ca 2.5 and a is ca 1.

EXAMPLE IV

| Material | Grams | Moles |
|---|---|---|
| polyisobutenyl ($\overline{M}_n$ 1290) succinic acid anhydride | 200 | 0.138 |
| pentaethylenehexamine | 23.3 | 0.090 |
| 100 E Pale Stock HF | 223.3 | — |
| 1,3,6-hexane-tricarboxylic acid | 22.4 | 0.108 |
| silcone oil antifoamant | 0.05 ml | |

The procedure of Example II is followed.
The reaction mixture contains:

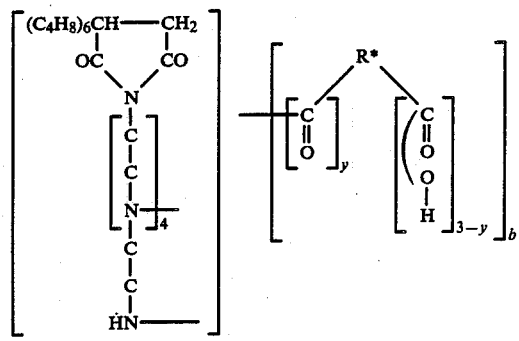

wherein
y is ca 2.5 and
b is ca 1.2

The reaction mixture also contains 50 w% of the analogue containing two succinimide rings wherein y is ca 2.5 and b is ca 0.85

These products are analyzed for % nitrogen, Total Base Number TBN by ASTM D-2896 and Total Acid Number by ASTM d-974.

| Example | % N | TBN | TAN |
|---|---|---|---|
| I | 1.17 | 17.2 | 10.3 |
| II | 0.95 | 13.0 | 11.1 |
| III | 1.15 | 21.5 | 12.1 |
| IV | 1.58 | 3.03 | 9.70 |

EXAMPLE V

In this example which illustrate the best mode presently known of practing the invention, the Diesel Fuel cut from H-Oil (set forth supra) is treated according to the process of the invention. There is added to this oil, 25 PTB of the active ingredient product of Example I (in a mixture with 100 E Pale Oil diluent oil).

The resultant formulation is tested according to the PDT Test.

EXAMPLE VI*

In this control Example, the procedure of Example V is followed except that no additive is added to the Diesel Fuel cut from H-Oil.

TABLE

| Example | PDT Test |
|---|---|
| V | 2 |
| VI* | 3 |

In this test, a rating of 1–2 is satisfactory. A rating of 3–4 as unsatisfactory.

From this table it is apparent that the additive of this invention permits attainment of improved stability as measured by the PDT, ASTM D-2274.

EXAMPLE VII

In this Example, the procedure of Example I is followed using the following materials:

TABLE

| Material | Grams | Moles |
|---|---|---|
| Polyisobutenyl ($\overline{M}_n$ 1290) succimic acid anhydride of | 400 | 0.185 |

TABLE-continued

| Material | Grams | Moles |
|---|---|---|
| Sap No 51.9 | | |
| 100 E Pale Stock | 383 | — |
| HF diluent oil | | |
| pentaethylene | 31.3 | 0.65 |
| hexamine (Dow Chemical | | |
| E-100 PEHA) | | |
| Citric Acid | 23 | 0.65 |
| Silicone oil | 0.1 ml | |
| antifoamant | | |

EXAMPLE VIII

In this Example, the procedure of Example VII is duplicated except trimellitic acid is used instead of an equal weight of citric acid.

The products are tested (at a level of 25 PTB in a standard D-2 diesel fuel derived from H-oil) in the Potential Deposit Test against control Example IX* in which no additive is present.

TABLE

| Example | % Nitrogen | PDT |
|---|---|---|
| VII | 1.19 | 1 + |
| VIII | 1.13 | 1 + |
| IX* | — | 4 + |

From the Table, its apparent that the additives of this invention permit attainment of desirably low values on the PDT when used in a diesel fuel derived from H-Oil.

Although this invention has been illustrated by reference to specific embodiments, it will be apparent to those skilled in the art that various charges and modifications may be made which clearly fall within the scope of the invention.

We claim:

1. A middle distillate hydrocarbon composition characterized by its stability in the presence of air comprising a major portion of a middle distillate hydrocarbon oil and a minor effective stabilizing portion, as an additive, of the product prepared by reaction of (i) a hydrocarbyl-substituted mono- or bis-succinimide bearing polyamine

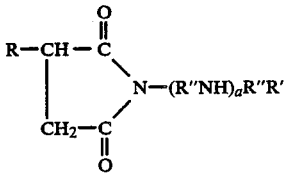

wherein

R is an alkenyl group containing about 8–400 carbon atoms;

R″ is a divalent hydrocarbon group selected from the group consisting of alkylene, alkarylene, aralkylene, cycloalkylene, arylene, alkenylene, and alkynlene;

R′ is —$NH_2$, —NHR‴ or a hydrocarbyl-substituted succinimide group

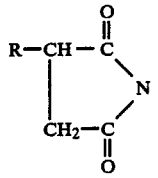

R‴ is a hydrocarbon group selected from the group consisting of alkyl, alkaryl, aralkyl, alkenyl, alkynyl, cycloalkyl, and aryl;

a is an integer 1–8 with (ii) an organic polycarboxylic acid R* $(COOH)_x$ wherein x is an integer 3–6; and R* is a hydrocarbon group derived by removing a–1 hydrogen atoms from an alkyl, alkaryl, aralkyl, cycloalkyl, aryl, alkenyl, or alkynyl hydrocarbon group thereby forming product; and recovering said product.

2. A middle distillate hydrocarbon composition as claimed in claim 1 wherein said succinimide is a polyisobutylene-substituted succinimide.

3. A middle distillate hydrocarbon composition as claimed in claim 2 wherein said polyisobutylene moiety contains about 70–170 carbon atoms.

4. A middle distillate hydrocarbon composition as claimed in claim 2 wherein said polyisobutylene moiety has a molecular weight of 900–2000.

5. A middle distillate hydrocarbon composition as claimed in claim 1 wherein R′ is $NH_2$.

6. A middle distillate hydrocarbon composition as claimed in claim 1 wherein R″ is —$CH_2CH_2$—.

7. A middle distillate hydrocarbon composition as claimed in claim 1 wherein said succinimide is

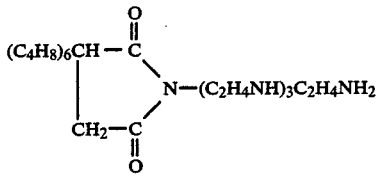

8. A middle distillate hydrocarbon composition as claimed in claim 1 wherein R* is a polyvalent hexyl group.

9. A middle distillate hydrocarbon composition as claimed in claim 1 wherein x is 3.

10. A middle distillate hydrocarbon composition as claimed in claim 1 wherein said organic polycarboxylic acid is 1,3,6-hexane tricarboxylic acid.

11. A middle distillate hydrocarbon composition as claimed in claim wherein said organic polycarboxylic acid is citric acid.

12. A middle distillate hydrocarbon composition as claimed in claim 1 wherein said organic polycarboxylic acid is trimellitic acid.

13. A middle distillate hydrocarbon composition as claimed in claim 1 wherein said reaction is carried out in the presence of inert diluent-solvent.

14. A middle distillate hydrocarbon composition as claimed in claim 1 wherein said reaction is carried out with an amount of acid which is at least equivalent to the active amine groups present in the succinimide bearing a polyamine chain.

15. A middle distillate hydrocarbon composition as claimed in claim 1 wherein said additive is present in a minor effective amount of 0.005–0.05 w% of said middle distillate oil.

16. A middle distillate hydrocarbon composition as claimed in claim 1 wherein said additive is prepared by reacting (i) as first reactant

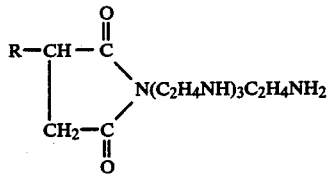

wherein R is a polyolefin group containing about 8–400 carbon atoms with (ii) as second reactant 1,3,6-hexane tricarboxylic acid thereby forming product; and recovering said product.

17. A middle distillate hydrocarbon composition as claimed in claim 1 wherein said additive is

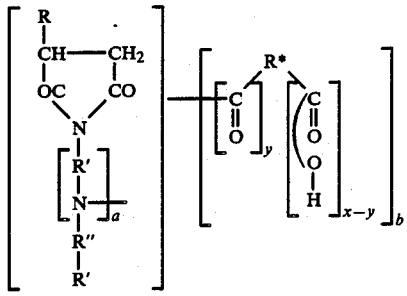

wherein y is 1–3;
x is 3–6
a is an integer 1–8;
b is 0.01–3
R″ is an alkylene, cycloalylene, arylene, alkarylene, or alkynlene hydrocarbon group;
R′ is —$NH_2$, —NHR‴, or a hydrocarbyl-substituted succinimide group; and
R‴ is an alkyl, alkaryl, aralkyl, alkenyl, alkynyl, cycloalkyl, or aryl hydrocarbon group.

18. A middle distillate hydrocarbon composition as claimed in claim 1 wherein said additive is

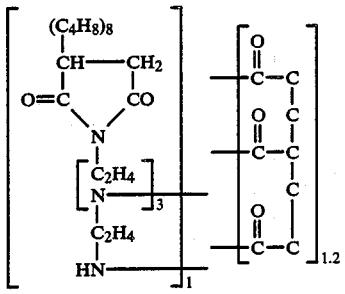

* * * * *